United States Patent [19]

Arff

[11] 4,021,913

[45] May 10, 1977

[54] SPROCKET NOSE CHAIN SAW

[75] Inventor: Uwe F. Arff, Peterborough, Canada

[73] Assignee: Outboard Marine Corporation, Waukegan, Ill.

[22] Filed: Jan. 22, 1976

[21] Appl. No.: 651,409

[52] U.S. Cl. ..... 30/384

[51] Int. Cl.[2] ..... B27B 17/04

[58] Field of Search ..... 30/384, 385, 386, 387

[56] References Cited

UNITED STATES PATENTS

| | | | |
|---|---|---|---|
| 285,651 | 9/1883 | Newlove | 30/387 |
| 3,124,177 | 3/1964 | Ekrud | 30/384 |
| 3,279,508 | 10/1966 | Ehlen | 30/385 |

*Primary Examiner*—James L. Jones, Jr.
*Assistant Examiner*—J. C. Peters
*Attorney, Agent, or Firm*—Michael, Best & Friedrich

[57] ABSTRACT

Disclosed herein is a chain saw comprising an elongated cutter bar having, at the outer edges thereof, laterally spaced side rails, together with a curved end portion including laterally spaced side plates and a journalled idler wheel with a peripheral outer surface extending between the side plates and having a plurality of spaced outwardly extending lobes, and an endless saw chain trained around the cutter bar and having pivotally connected side and center links, each of the side links having a bottom surface, which during semicircular traversal of the curved end portion engages one of the side rails to provide partial support for the chain traversing the curved end portion, each of the center links having a lower portion which includes a forward edge extending downwardly between the side rails with at least one of the forward edges being in contact with one of the lobes to insure rotation of the idler wheel during chain traversal of the curved end portion, each of the center link lower portions also having a bottom edge which, when unworn and during semicircular traversal of the curved end portion, engages the peripheral outer surface of the idler wheel to provide partial support for the chain traversing the curved end portion.

8 Claims, 3 Drawing Figures

SPROCKET NOSE CHAIN SAW

BACKGROUND OF THE INVENTION

The invention relates to the art of chain saws, and more particularly to devices for reducing the power loss and wear resulting from friction when the cutting chain traverses the curved end portion of a cutter bar during chain saw operation. Specifically, the invention relates to a sprocket nose chain saw.

Prior sprocket nose chain saw constructions are disclosed in the U.S. Ekrud Pat. No. 3,124,177 issued Mar. 10, 1964 and in the U.S. Scott-Jackson Pat. No. 3,762,047 issued Oct. 2, 1973.

SUMMARY OF THE INVENTION

The invention provides a chain saw comprising an elongated cutter bar having at the outer edges thereof, laterally spaced side rails, together with a curved end portion including laterally spaced side plates and a journalled idler wheel with a peripheral outer surface extending between the side plates and having a plurality of spaced outwardly extending lobes. In addition, the chain saw includes an endless saw chain which is trained around the cutter bar and which has pivotally connected side and center links. Each of the side links has a bottom surface, which during semicircular traversal of the curved end portion, engages and is partially supported by one of the side rails of the curved end portion to provide partial support for the chain traversing the curved end portion. Each of the center links has a lower portion which includes a forward edge extending downwardly between the side rails with at least one of the forward edges being in contact with one of the lobes to insure rotation of the idler wheel during chain traversal around the curved end portion. Each of the center link lower portions also has a bottom edge which, when unworn and during semicircular traversal of the curved end portion, engages the peripheral outer surface of the idler wheel so as to provide partial support for the chain and thereby reduces the radial load and wear on the side links consequent to chain traversal of the curved end portion.

In accordance with an embodiment of the invention, the outwardly extending lobes of the idler wheel are peripherally spaced and dimensioned with respect to the dimensions of the bottom edges of the center links so that the idler wheel is generally insensitive to an increase in pitch of the forward edges of the center links. Accordingly, as the saw chain wears, it remains under tension as it traverses the curved end portion.

Also in accordance with an embodiment of the invention, the lower portions of the center links are dimensioned with respect to the laterally spaced side rails so that the center and side links are generally restrained against lateral movement as the center and side links traverse the curved end portion.

One of the principal features of the invention is the provision of a sprocket nose chain saw wherein the radial load on the saw chain is shared by engagement of the side links of the chain with the side rails of a cutter bar and by engagement of the center links of the chain with the peripheral surface of an idler wheel.

Another of the principal features of the invention is the provision of a sprocket nose chain saw having a saw chain with side links having bottom surfaces which engage the side rails of the curved end portion of a cutter bar as the chain tranverses under tension around the curved end portion, which engagement prevents or substantially reduces unwanted pivoting or kickback of the saw chain during cutting operations.

Another principal feature of the invention is the provision of a sprocket nose chain saw having a journalled idler wheel which is generally insensitive to pitch changes in the chain resulting from stretch and wear so that the chain, when worn, is maintained under tension as the chain traverses the curved end portion of the cutter bar.

Another principal feature of the invention is the provision of a sprocket nose chain saw having center links with lower portions which are dimensioned with respect to the laterally spaced side rails to provide lateral stability for the saw chain as the chain traverses around the curved end portion during cutting operations.

Another principal feature of the invention is the provision of a sprocket nose chain saw with the lower portions of the center links having bottom edges which engage the peripheral outer surface of the journalled idler wheel to provide partial support for the saw chain as it traverses around the curved end portion of the cutter bar, thus reducing wear of the side links.

Other features and advantages of the embodiments of the invention will become known by reference to the following general description, appended claims, and drawings.

Figure 1:
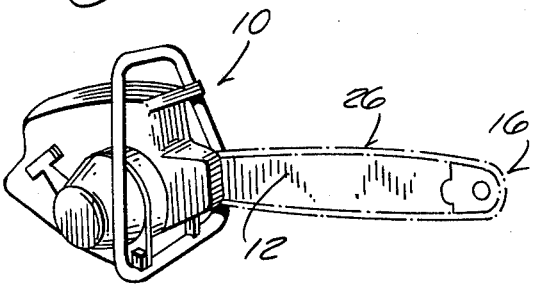
FIG. 1 is a perspective view of a chain saw incorporating various of the features of the invention.

Before explaining one of the embodiments of the invention in detail, it is to be understood that the invention is not limited in its application to the details of construction and the arrangements of components set forth in the following description or illustrated in the drawings. The invention is capable of other embodiments and being practiced and carried out in various ways. Also, it is to be understood that the phraseology and terminology employed herein is for the purpose of description and should not be regarded as limiting.

GENERAL DESCRIPTION

Shown in the drawings is a sprocket nose chain saw 10 having an elongated cutter bar 12 which can be of either one piece or laminated construction. The cutter bar 12 has, at the outer edges thereof, laterally spaced side rails 14 and has a curved end portion 16 including laterally spaced side plates 15 and a journalled idler wheel 18 extending between the side plates 15. The idler wheel 18 can be mounted between the side plates 15 in any conventional manner, such as on bearings 20. The idler wheel 18 has a peripheral outer surface 22 including a plurality of outwardly extending lobes 24.

Figure 2:
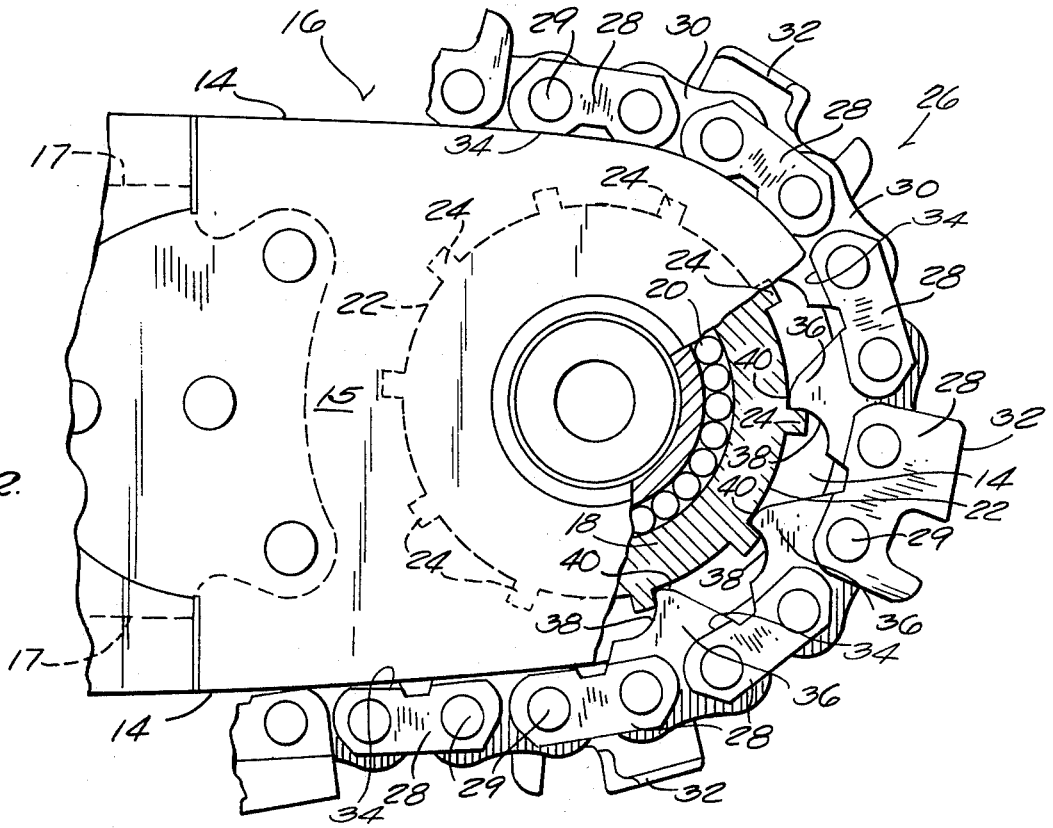
FIG. 2 is an enlarged partial side view of the chain saw cutter bar which is incorporated in the chain saw shown in FIG. 1 and which is shown with an end portion broken away.

The laterally spaced side rails 14 extend along the outer edges of the cutter bar 12 to a depth indicated by the dotted lines 17 as shown in FIG. 2, and also extend along the outer edges of the laterally spaced side plates 15 of the curved end portion 16. The laterally spaced side rails 14 in effect define a guide for the lower portion of a saw chain as will be explained in more detail below.

An endless saw chain 26 is mounted on the cutter bar 12 and includes pivotally connected side and center links 28 and 30, respectively. Some of the side links 28 have outwardly projecting cutting surfaces 32. The links can be pivotally connected together in any conventional manner such as by the use of rivets 29 passing through aligned holes (not shown) in adjacent links, the links being pivotally connected to substantially prevent translational movement of the links with respect to each other.

Each of the side links 28 has a bottom surface 34 which, during generally semicircular traversal of the curved end portion 16, engages and is partially supported by one of the side rails 14 of the curved end portion 16, which side rails 14 provide partial support for the saw chain 26 traversing the curved end portion 16.

Each of the center links 30 has a lower portion 36 which includes a forward edge 38 extending downwardly between the side rails 14 with at least one of the forward edges 38 being in contact with one of the lobes 24 to insure rotation of the idler wheel 18 when the chain 26 traverses around the curved end portion 16. Each of the lower portions 36 also includes a bottom edge 40 which, when unworn and during semicircular traversal of the curved end portion 16, engages the outer peripheral surface 22 to provide partial support for the saw chain and reduces the load between the side links 28 and the side rails 14 so as to reduce side link wear consequent to chain travel around the curved end portion 16.

As noted above, when newly manufactured or in an unworn condition, the chain 26, during semicircular traversal of the curved end portion 16, is partially supported by both the side rails 14 and the outer surface 22 of the journalled idler wheel 18. For relatively small chain saw applications, the invention disclosed herein provides a chain saw having particularly stable cutting characteristics. More particularly, the continuous engagement of the bottom surfaces 34 of the side links 28 with the side rails 14 of the curved end portion 16 during semicircular traversal of the curved end portion 16 substantially prevents unwanted pivotal movement of the links, thus reducing the incidence and degree of chain saw kickback. Further, the links of the chain 26 are generally laterally stable since the lower portions 36 of the center links 30 are located between the side rails 14, remain in engagement with the idler wheel 18 during semicircular traversal of the curved end portion 16, and are dimensioned to be guided and generally restrained against lateral movement by the side rails 14. The power loss and wear resulting from the engagement of the bottom surfaces 34 of the side links 28 with the side rails 14 is reduced since the chain 26 is partially supported by engagement of the outer surface 22 of the journalled idler wheel 18 with the bottom edges 40 of the center links 30.

As noted, when the chain 26 is newly manufactured, the pivotal connections substantially prevent translational movement in the direction of the chain of the side and center links with respect to one another. At this stage when the chain is unworn, the pitch of the forward edges 38 of the lower portions 36 of the center links 30 and the pitch of the lobes 24 of the idler wheel 18 are generally the same so that, during semicircular traversal of the curved end portion 16, each of the forward edges 38 is in contact with one of the lobes 24 of the idler wheel 18.

Figure 3:
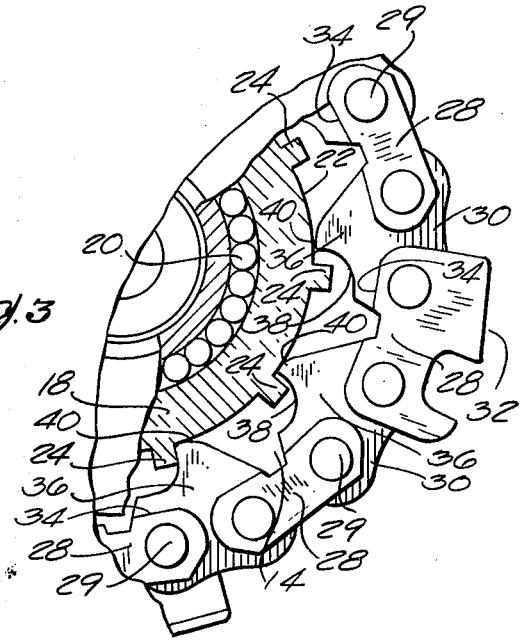
FIG. 3 is a partial side view of the cutter bar shown in FIG. 2 illustrating the spacing of a generally worn saw chain with respect to the idler wheel, which spacing is exaggerated for illustration purposes.

As shown in FIG. 3, when the pitch of the chain 26 is increased due to the wear of the pivotal connections and stretching of the links, some of the forward edges 38 become spaced from the lobes 24. Since the peripheral spacing between the lobes 24 is greater than the dimensions of the bottom edges 40 engaging the peripheral outer surface 22, the idler wheel 18 is generally insensitive to an increase in pitch of the chain 26 as it wears and, hence, the chain 26 remains under tension during traversal of the curved end portion 16. When the chain is in a generally worn condition, at least one of the forward edges 38 is in contact with one of the lobes 24 to insure rotation of the idler wheel 18 during chain traversal of the curved end portion 16.

Various features of the invention are set forth in the following claims: What is claimed is:

1. A chain saw comprising an elongated cutter bar having, at the outer edges thereof, laterally spaced side rails, said cutter bar also having a curved end portion including laterally spaced side plates and a journalled idler wheel with a peripheral outer surface extending between said side plates and having a plurality of spaced outwardly extending lobes, and an endless saw chain trained around said cutter bar and having pivotally connected side and center links, each of said side links having a bottom surface which, during semicircular traversal of said curved end portion, engages and is partially supported by one of said side plates of said curved end portion, each of said center links having a lower portion which includes a forward edge extending inwardly between said side plates with at least one of said forward edges being in contact with one of said lobes to insure rotation of said idler wheel during chain traversal around said curved end portion, each of said lower portions also having a bottom edge which, when unworn and during semicircular traversal of said curved end portion, engages said peripheral outer surface of said idler wheel to provide partial support for said side links engaging said side plates of said curved end portion.

2. A chain saw in accordance with claim 1 wherein, during semicircular traversal of said curved end portion, each of said forward edges is in contact with one of said outwardly extending lobes of said idler wheel when said saw chain is in a generally unworn condition.

3. A chain saw in accordance with claim 1 wherein said outwardly extending lobes of said idler wheel are peripherally spaced and dimensioned with respect to said bottom edges so that said idler wheel is generally insensitive to an increase in pitch of said forward edges and so that said saw chain remains under tension during chain traversal of said curved end portion notwithstanding wear.

4. A chain saw in accordance with claim 1 wherein said lower portions of said center links are dimensioned with respect to said laterally spaced side plates so that said center and side links are generally restrained against lateral movement during semicircular traversal of said curved end portion.

5. A chain saw comprising an elongated cutter bar having a curved end portion including laterally spaced side plates and a journalled idler wheel with a peripheral outer surface extending between said side plates and having a plurality of spaced outwardly extending lobes, and an endless saw chain trained around said cutter bar and having pivotally connected side and center links, each of said side links having a bottom surface which, during semicircular traversal of said curved end portion, engages one of said side plates to provide partial support for said chain traversing said curved end portion, each of said center links having a lower portion which includes a forward edge extending inwardly between said side plates with at least one of said forward edges being in contact with one of said lobes to insure rotation of said idler wheel during chain traversal around said curved end portion, each of said lower portions also having a bottom edge which, when unworn and during semicircular traversal of said curved end portion, engages said peripheral outer surface of said idler wheel to provide partial support for said chain traversing said curved end portion.

6. A chain saw in accordance with claim 5 wherein, during semicircular traversal of said curved end portion, each of said forward edges is in contact with one of said outwardly extending lobes of said idler wheel when said saw chain is in a generally unworn condition.

7. A chain saw in accordance with claim 5 wherein said outwardly extending lobes of said idler wheel are peripherally spaced and dimensioned with respect to said bottom edges so that said idler wheel is generally insensitive to an increase in pitch of said forward edges and so that said saw chain remains under tension during chain traversal of said curved end portion notwithstanding wear.

8. A chain saw in accordance with claim 5 wherein said lower portions of said center links are dimensioned with respect to said laterally spaced side plates so that said center and side links are generally restrained against lateral movement during semicircular traversal of said curved end portion.

* * * * *